United States Patent [19]

Gavilan

[11] Patent Number: 4,820,126

[45] Date of Patent: Apr. 11, 1989

[54] TURBOMACHINE ROTOR ASSEMBLY HAVING REDUCED STRESS CONCENTRATIONS

[75] Inventor: William A. Gavilan, Pfafftown, N.C.

[73] Assignee: Westinghouse Electric Corp., Pittsburgh, Pa.

[21] Appl. No.: 158,814

[22] Filed: Feb. 22, 1988

[51] Int. Cl.[4] ..... F01D 5/30

[52] U.S. Cl. ..... 416/221; 416/213 R

[58] Field of Search ..... 416/213 R, 221

[56] References Cited

U.S. PATENT DOCUMENTS

| | | | |
|---|---|---|---|
| 1,793,468 | 5/1929 | Densmore . | |
| 2,255,486 | 9/1941 | Doran . | |
| 2,317,338 | 4/1943 | Rydmark . | |
| 2,429,215 | 10/1947 | Boestad . | |
| 2,781,998 | 2/1957 | Barr . | |
| 3,045,968 | 7/1962 | Willis . | |
| 3,317,988 | 5/1967 | Endres | 416/219 R |
| 3,784,320 | 1/1974 | Rossmann et al. | 416/215 |
| 3,809,495 | 5/1974 | Stahl | 416/135 |
| 3,904,317 | 9/1975 | Cardin et al. | 416/220 |
| 3,910,719 | 10/1975 | Hessler et al. | 416/134 |
| 4,169,694 | 10/1979 | Sanday | 416/219 R |
| 4,207,029 | 6/1980 | Ivanko | 416/241 B |
| 4,323,394 | 4/1982 | Hoffmüller et al. | 416/213 R |
| 4,417,854 | 11/1983 | Cain et al. | 416/241 B |
| 4,613,388 | 9/1986 | Walter et al. | 148/425 |

FOREIGN PATENT DOCUMENTS 2101635A 7/1982 United Kingdom .

*Primary Examiner*—Everette A. Powell, Jr.

[57] ABSTRACT

A method and apparatus for reducing stress concentrations in a turbomachine rotor assembly are disclosed. A layer of superplastic metal is applied to a bearing surface formed on the turbine blade root. After assembly of the turbine blade to the rotor disk, the blade is preloaded to bring the superplastic metal layer into contact with adjoining bearing surfaces formed in the rotor disk groove. The superplastic metal material is capable of plastically deforming at least 500% thereby conforming to substantially all of the variations between the bearing surface formed on the blade root and the corresponding bearing surface formed on the rotor disk groove. By maximizing the contact area between the bearing surfaces, the stress concentrations are reduced.

15 Claims, 3 Drawing Sheets

TURBOMACHINE ROTOR ASSEMBLY HAVING REDUCED STRESS CONCENTRATIONS

BACKGROUND OF THE INVENTION

1. Field of the Invention

The invention relates to a turbomachine rotor assembly, more particularly such an assembly wherein the stress concentrations between the blade root and the rotor disk are reduced.

2. Description of the Prior Art

Many ways of attaching turbine rotor blades to a turbine rotor disk have been proposed in the many years turbomachines have been in use. Typically, the turbine blades have been formed with a root having a specific cross sectional shape, such as a dovetail or "fir-tree", which is inserted into a correspondingly shaped groove formed in the turbine rotor disk. The groove may be formed extending circumferentially about the rotor disk, or a plurality of axially extending grooves may be formed about the periphery.

The blade root and the rotor disk groove have interlocking surfaces so as to prevent the radial movement of the turbine blades with respect to the rotor disk during operation of the turbomachine. Ideally, the blade root and the rotor disk groove have minimal clearances to prevent any vibration or unnecessary motion between the blade and the disk. Also, the control bearing surfaces should be absolutely parallel to each other to ensure the maximum bearing area so as to minimize stress concentration.

As a practical matter, however, there must be adequate tolerances between the blade root and the grooves in the rotor disk in order to facilitate the assembly of these elements. Also, the surfaces formed on the blade root and those corresponding surfaces formed on the rotor disk invariably have surface blemishes and a degree of non-parallelism which serves to concentrate the stresses in those areas where contact between these surfaces takes place.

Devices have been proposed to apply a pre-load force between the turbine blade root and the rotor disk in order to take up the clearances between the interengaging surfaces. Although these devices have been successful, they have not alleviated the problems generated by the non-parallelism of the surfaces, the surface defects, or other factors which create increased stress concentrations in the contact areas between the surfaces.

In the field of high-temperature gas turbines, it has been proposed to incorporate a compliant layer of material between the blade root and the rotor disk groove to minimize stresses imparted to brittle, ceramic blade roots. These typically have included placing a metallic felt layer between the surfaces, forming the entire "fir tree" root from a compliant material, or forming compliant areas on the sides of the rotor disk groove by machining methods. All of the known devices have served to increase both the cost and complexity of manufacturing the turbo machine and, consequently, have not acheived an ideal solution to the problem.

It is also known to form superplastic metallic articles, including a fiber reinforced structure, by electrodeposition or electroforming processes.

SUMMARY OF THE INVENTION

The present invention relates to a method and apparatus for reducing stress concentrations in a turbomachine rotor assembly. The invention involves the application of a layer of superplastic metal to a bearing surface formed on the turbine blade root. After assembly of the turbine blade to the rotor disk, the blade is pre-loaded in order to bring the superplastic metal layer into contact with adjoining bearing surfaces formed in the rotor disk groove. The superplastic metal material is capable of plastically deforming at least 500%, thereby conforming to substantially all of the variations between the bearing surface formed on the blade root and the corresponding bearing surface formed on the rotor disk groove. By maximizing the contact area between the bearing surfaces, the stress concentrations are reduced. Since stress is defined as the force per unit area, increasing the area of contact will reduce stress concentrations.

The superplastic metal layer may comprise a hypereutectoid nickel chrome alloy which may be applied to the blade root by an electroplating or other suitable processes such as metal vapor deposition such that it has a nominal thickness of approximately 0.0025–0.075 mm (0.0001–0.003 inches).

DESCRIPTION OF THE PREFERRED EMBODIMENT

Figure 1:
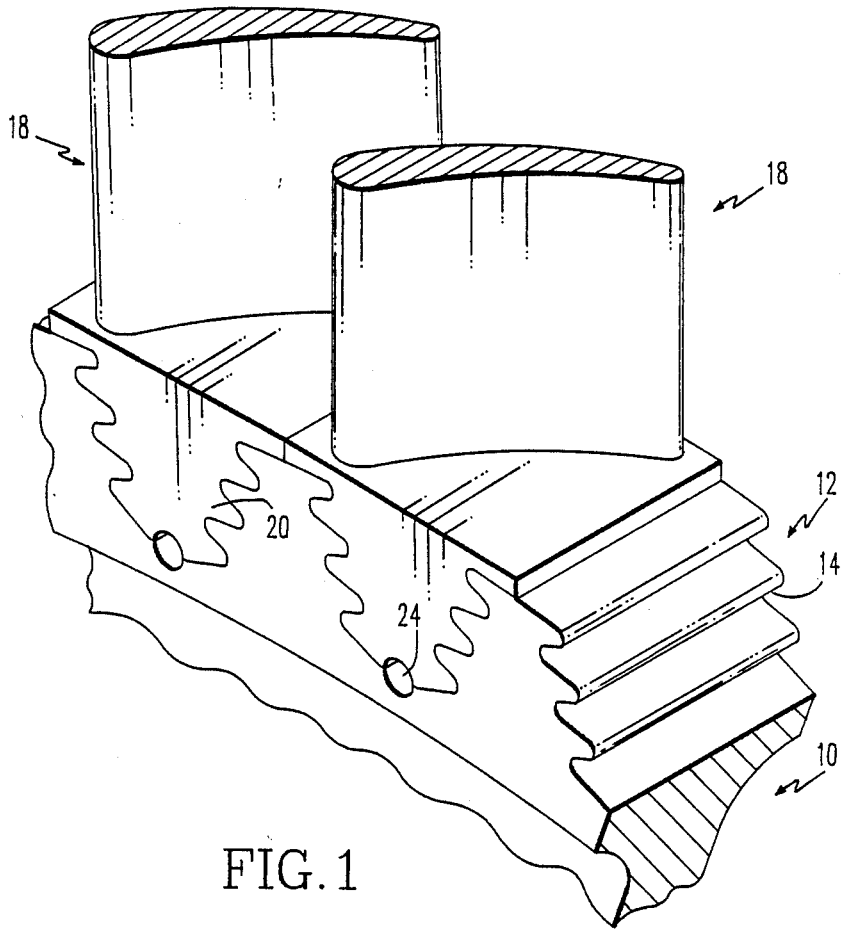
FIG. 1 is a partial perspective view of a turbo machine rotor assembly.
Figure 2:
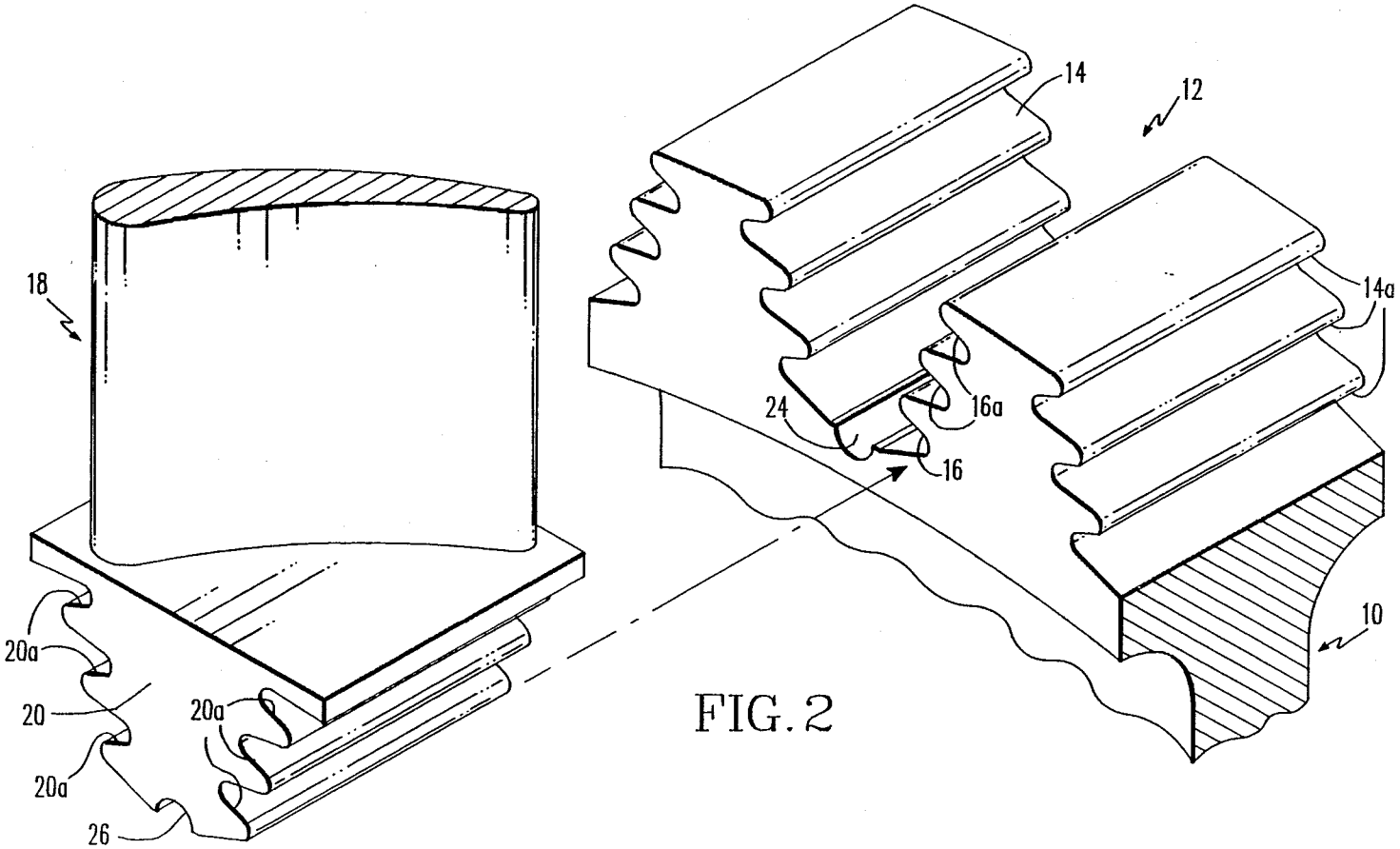
FIG. 2 is a partial, exploded perspective view showing the assembly of a turbine blade to the rotor disk.
Figure 3:
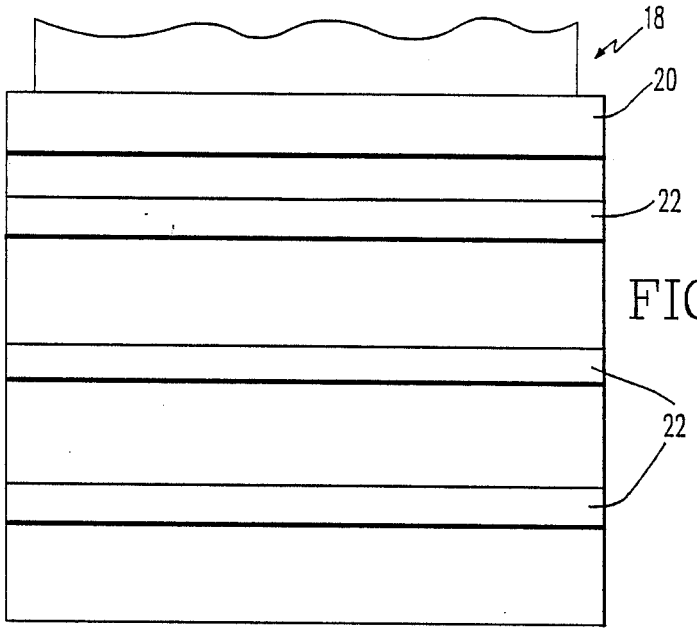
FIG. 3 is a partial side view of a turbine blade showing a blade root according to the present invention.
Figure 4:
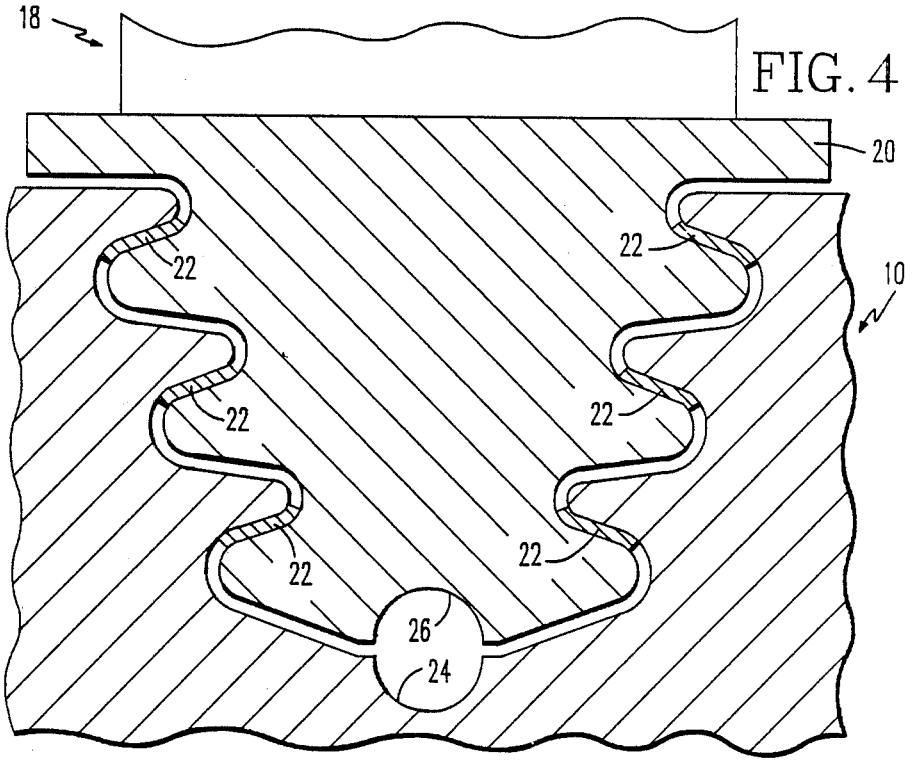
FIG. 4 is a partial, cross sectional view showing the superplastic layer according to the invention between a blade root and a rotor disk groove.

A rotor disk 10 is partially shown in FIGS. 1 and 2 defining a plurality of generally axially extending grooves 12 defined by sides 14 and 16. Although the principles of the invention will be described in conjunction with grooves having a generally known "fir tree" configuration extending generally parallel to a longitudinal axis of the rotor disk 10, it is to be understood that they are equally applicable to other groove configurations and orientations, which should be included in the scope of this invention.

Blades 18, each having a root portion 20, are assembled into each of the grooves 12 by axially sliding the root portion 20 into the groove 12 as illustrated in FIG. 2. Root portion 20 is shaped so as to have a substantially identical configuration with sides 14 and 16 of groove 12. Quite obviously, tolerances must be provided between the blade root portions 20 and the grooves 12 in order to facilitate the assembly of the elements.

After forming the root portions 20, but prior to assembling them with the rotor disk 10, a layer of superplastic metal is applied to each of the bearing surfaces **20*a*. As illustrated in the figures, bearing surfaces 20*a* are those which face generally radially outwardly. Sides 14 and 16 of grooves 12 define corresponding bearing surfaces 14*a* and 16*a*, respectively, which face generally radially inwardly and are aligned with corresponding bearing surfaces 20*a*. Due to the practicalities of manufacturing the elements, surfaces 14*a*, 16*a* and 20*a*** will exhibit a certain degree of non-parallelism and may also have surface imperfections which prevent full contact between the corresponding bearing surfaces.

The layer of superplastic metal may comprise a hypereutectoid nickel chrome alloy which is applied to the bearing surfaces 20*a* by electroplating, metal vapor deposition or other suitable processes. Preferably the layer is applied to a nominal a thickness of between 0.0025 and 0.075 mm (0.0001 and 0.003 inches) and is capable of plastically deforming at least 500%.

Examples of other superplastic alloys which may be utilized include, but are not limited to:

(1) Nickel-chrome Kh 20 N 80
(2) Nickel Modified Titanium 6 ALuminum 4 Vanadium
(3) Zinc-Aluminum
(4) Nickel 75% Boron 17% Silcon 8%
(5) Aluminum-Copper Eutectic
(6) Zh S 6U - Heat Resistant Alloy After the application of the superplastic metal layer 22 to the surfaces 20*a*, the root 20 is assembled with a groove 12 as illustrated in FIG. 2. The bottom of the groove 12 defines a notch 24 which is aligned with a corresponding notch 26 formed in the bottom of blade roots 20. Notches 24 and 26 define an opening to accommodate a pre-load device to apply a pre-load to the blade root 20. The pre-load device is not shown in detail, since such devices are well known in the art and any such device may be utilized in accordance with this invention.

The pre-load applied to the blade roots 20 not only serves to take up the clearances between respective bearing surfaces formed on the blade root and the rotor disk, but also serves to compress and deform the superplastic layers 22 such that they conform to the variations between the surfaces 14*a* and 16*a*, and the adjacent surfaces 20*a* thus increasing their contact area. By increasing the contact area between the respective surfaces, the stress concentrations between the blade root and the rotor disk are reduced.

Although the superplastic metal layer has been described as being applied only to the blade root bearing surfaces, it is to be understood that such layers could also be applied to the bearing surfaces 14a and 16a of the grooves 12. Furthermore, the layer may be applied so as to cover all of the sides of the blade root or the sides of the grooves 12, respectively.

It also may be necessary to apply heat to the joined elements to assist in the deformation of the superplastic layer. Heat can be applied by any known heat source and the amount of heat applied will vary according to the superplastic material, the size of the blade root and rotor disk and the material from which these elements are fabricated.

The foregoing description is provided for illustrative purposes only and should not be construed as in any way limiting this invention, the scope of which is defined solely by the appended claims.

I claim as my invention:

1. A turbomachine rotor assembly having reduced stress concentrations comprising:

(a) a rotor disk rotatably about a central axis, defining at least one groove having at least a portion of one side forming a first bearing surface;
(b) at least one turbine blade having a root portion slidably received in the at least one groove, the root portion defining at least one second bearing surface located adjacent and extending generally parallel to the first bearing surface;
(c) a layer of superplastic metal in contact with the at least one first and second bearing surfaces to maximize the area of contact between the first and second bearing surfaces, thereby reducing stress concentrations in the blade root portion and the rotor disk; and
(d) a pre-load device disposed between the groove of said rotor disk and the root of said blade such that a preload is applied to compress and deform said superplastic metal to increase the contact area therebetween.

2. The turbomachine rotor assembly of claim 1 wherein the superplastic metal is applied to the at least one second bearing surface on the blade root portion.

3. The turbomachine rotor as defined in claim 1 wherein said at least one second bearing surface has an electroplated superplastic metal thereon.

4. The turbomachine rotor assembly of claim 1 wherein the superplastic metal is capable of plastically deformed at least 500% upon application of the preload by said pre-load device.

5. The turbomachine rotor assembly of claim 1 wherein the superplastic metal is a hypereutectoid nickel chrome alloy.

6. The turbomachine rotor assembly of claim 1 wherein the superplastic metal has a nominal thickness in the range of approximately 0.0001–0.003 inches.

7. The turbomachine rotor assembly of claim 1 wherein the at least one groove extends generally parallel to the central axis.

8. A turbomachine rotor assembly having reduced stress concentrations comprising:

(a) a rotor disk rotatable about a central axis, the rotor disk defining at least one groove extending generally in an axial direction generally parallel to the central axis such that sides of the groove define a plurality of first bearing surfaces;
(b) at least one turbine blade having a root portion slidably received in the at least one groove, the root portion defining a plurality of second bearing surfaces located adjacent and extending parallel to the plurality of first bearing surfaces; and,
(c) a layer of hypereutectoid nickel chrome alloy having a nominal thickness of approximately .001 inches and capable of plastically deforming at least 500% electroplated onto the plurality of second bearing surfaces and contacting the plurality of adjacent first bearing surfaces so as to maximize the contact area between the first and second bearing surfaces so as to evenly distribute a pre-load stress over the bearing surfaces thereby reducing stress concentrations in the root portion and the rotor disk.

9. A method of reducing stress concentrations in a turbomachine rotor assembly comprising the steps of:

(a) forming at least one groove in a turbomachine rotor disk such that the groove defines at least one first bearing surface;
(b) forming a root portion of at least one turbine blade so as to define at least one second bearing surface;
(c) applying a layer of superplastic metal to the at least one second bearing surface;
(d) placing the at least one turbine blade in the at least one groove such that the bearing surfaces are adjacent to each other; and,
(e) applying a pre-load to the root portion so as to deflect the superplastic metal layer such that it conforms to any variations existing between the first and second bearing surfaces thereby evenly distributing the pre-load stress and reducing stress concentrations.

10. The method of claim 9 wherein applying the superplastic metal comprises the step of electroplating the superplastic metal onto the at least one second bearing surface.

11. The method of claim 9 wherein the superplastic metal is a hypereutectoid nickel chrome alloy.

12. The method of claim 9 wherein the superplastic metal is applied to the at least one second bearing surface so as to have a nominal thickness in the range of approximately 0.0001–0.003 inches.

13. The method of claim 9 wherein forming the at least one groove comprises the step of forming the at least one groove so as to extend generally parallel to a central axis of the rotor disk.

14. The method of claim 9 wherein the superplastic metal applied to the at least one second bearing surface is capable of plastically deforming at least 500%.

15. A method of reducing stress concentrations in a turbomachine rotor assembly comprising the steps of:

(a) forming a plurality of grooves in a turbomachine rotor disk such that the grooves extend generally parallel to a central axis of the rotor disk and defines a plurality of first bearing surfaces;

(b) forming root portions of a plurality of turbine blades so as to define a plurality of second bearing surfaces;

(c) electroplating onto the plurality of second bearing surfaces a layer of hypereutectoid nickel chrome alloy capable of plastically deforming at least 500% such that the layer has a nominal thickness of approximately 0.001 inches;

(d) placing a blade root in each of the plurality of grooves such that first and second bearing surfaces are adjacent to each other; and, (e) applying a pre-load to each root portion such that the layers of hypereutectoid nickel chrome alloy contact the adjacent first bearing surfaces so as to conform to any variations existing between the first and second bearing surfaces, thereby maximizing the contact area between the bearing surfaces so as to evenly distribute the pre-load stress and reduce stress concentrations.

* * * * *